US005782012A

United States Patent [19]

Sanders et al.

[11] Patent Number: 5,782,012

[45] Date of Patent: Jul. 21, 1998

[54] WRINKLE OUT CYCLE FOR A DRYER

[75] Inventors: Arlynn H. Sanders, Ripon; Khader I. Meshinesh, Oshkosh, both of Wis.

[73] Assignee: Raytheon Applicances Inc., Amana, Iowa

[21] Appl. No.: 734,000

[22] Filed: Oct. 18, 1996

[51] Int. Cl.[6] ..... F26B 13/10

[52] U.S. Cl. ..... 34/527; 34/543; 34/553; 34/564

[58] Field of Search ..... 34/486, 527, 533, 34/543, 550, 552, 553, 562, 564; 219/492

[56] References Cited

U.S. PATENT DOCUMENTS

| | | | |
|---|---|---|---|
| 3,662,186 | 5/1972 | Karklys | 34/527 X |
| 3,944,841 | 3/1976 | Janke | 34/528 X |
| 4,019,259 | 4/1977 | Veraart | 34/550 |
| 4,112,588 | 9/1978 | Marcade | 34/527 |
| 4,418,271 | 11/1983 | Smock | 219/493 |
| 4,506,458 | 3/1985 | Cochrane | 34/551 |
| 4,763,425 | 8/1988 | Grennan | 34/552 |

*Primary Examiner*—Henry A. Bennett
*Assistant Examiner*—Steve Gravini
*Attorney, Agent, or Firm*—Marshall O'Toole; Gerstein, Murray & Borun

[57] ABSTRACT

In a wrinkle release arrangement for a dryer, a heater heats articles to be wrinkle released, and a timer times the heating of the articles. The timer establishes a wrinkle out cycle. A temperature sensor senses a temperature related to a temperature of the articles. A control circuit substantially alternately energizes the heater and the timer in response to the temperature sensor in order to provide automatic wrinkle release responsive to load.

24 Claims, 4 Drawing Sheets

WRINKLE OUT CYCLE FOR A DRYER

TECHNICAL FIELD OF THE INVENTION

The present invention is directed to a dryer having a wrinkle out cycle for removing wrinkles from fabrics.

BACKGROUND OF THE INVENTION

Electromechanical dryers, such as clothes dryers, typically control the length of a drying cycle using one of two types of control, timer only control and automatic timer/temperature control. The timer only control executes a time controlled cycle that is controlled exclusively by a timer. Prior to starting the drying operation of a dryer implementing timer only control, the user selects a particular time controlled cycle, and the user sets a drying time for that selected time controlled cycle. The user then starts the dryer which runs for the selected amount of time. As the dryer runs, the articles to be dried are continuously tumbled, air is drawn into the dryer, the heater of the dryer is energized to heat the air which is then supplied to the articles to be dried, the heated air picks up moisture from the articles to be dried, and the moisture laden air is then exhausted from the dryer. The heater is controlled by a thermostat that monitors the temperature of the exhaust air. When the thermostat reaches its switching temperature, it opens in order to de-energize the heater. When the temperature of the exhaust air drops sufficiently to cause the thermostat to close, the heater is re-energized. Meanwhile, the timer continuously advances from its original selected timed setting to its heater off position whereat the functioning of the heater is terminated, and the timer advances through a predetermined end of cycle cool down time period of approximately five minutes. At the end of this cool down time period, the operation of the dryer ends.

The automatic timer/temperature control executes a cycle whose length is controlled by both the timer and a temperature sensor of the dryer. The user selects this automatic controlled cycle and starts the dryer. As the dryer runs, the articles to be dried are continuously tumbled, air is drawn into the dryer as before, the heater of the dryer is energized to heat the air which is then supplied to the articles to be dried, the heated air picks up moisture from the articles to be dried, and the moisture laden air is exhausted from the dryer. The heater is controlled by the temperature sensor that monitors the temperature of the exhaust air. However, unlike timer only control, the dryer's timer does not advance while the heater is energized. When the temperature sensor reaches a predetermined temperature, it causes the heater to be de-energized. The timer then advances while the heater is de-energized. When the temperature of the exhaust air drops sufficiently, the heater is re-energized, and the timer stops advancing. This process is repeated until the timer advances to its heater off position whereat the functioning of the heater is terminated, and the timer advances through a predetermined end of cycle cool down time period of approximately five minutes. At the end of this cool down time period, the operation of the dryer ends.

It is also known to use a moisture sensor in order to override the temperature sensor when the moisture sensor is satisfied. Accordingly, the moisture sensor locks out the heater when the moisture sensor is satisfied, and the timer is allowed to time out any remaining time.

Dryers have also included wrinkle out cycles during which articles are continuously tumbled, air is drawn into the dryer, and the heater of the dryer is controlled in response to a temperature sensor to heat the air which is then supplied to the articles in order to release any wrinkles therein. Wrinkle out cycles, however, have heretofore been exclusively time controlled cycles and, thus, have a fixed duration which is typically about fifteen minutes. The problem with a fixed duration wrinkle out cycle is that the amount of time required to heat a load to the proper temperature at which wrinkles are relaxed is dependent upon the size of the load. Larger loads require more time, and smaller loads require less time. Therefore, if the fixed duration of a wrinkle-out cycle is set for smaller loads, the wrinkles of larger loads may not be properly released. On the other hand, if the fixed duration of a wrinkle-out cycle is set for larger loads, too much time is expended on smaller loads, which wastes energy.

The present invention is directed to a dryer having a wrinkle out control which solves one or more of the above noted problems.

SUMMARY OF THE INVENTION

According to a first aspect of the present invention, a dryer having first and second automatic cycles comprises a heater, a timer, a temperature sensor, and a circuit. The first automatic cycle is an automatic wrinkle release cycle. The circuit includes the heater, the timer, and the temperature sensor. The circuit is arranged to energize the heater during each of the first and second automatic cycles in response to the temperature sensor, to energize the timer during periods of each of the first and second automatic cycles when the heater is not energized, and to de-energize the timer during periods of each of the first and second automatic cycles when the heater is energized.

According to another aspect of the present invention, a dryer comprises a heater, a timer, a temperature sensor, and a circuit. The circuit includes the heater, the timer, and the temperature sensor. The circuit is responsive to the temperature sensor to alternately energize the heater and the timer during first portions of first and second cycles and to continuously energize the timer during second portions of the first and second cycles. The first cycle is an automatic wrinkle release cycle.

According to yet another aspect of the present invention, a dryer has a circuit which includes a heater and a timer. The circuit is arranged to respond to load in order to alternately energize the heater and the timer during at least a portion of an automatic permanent press cycle, the circuit is arranged to respond to load in order to alternately energize the heater and the timer during at least a portion of an automatic regular cycle, the circuit is arranged to respond to load in order to alternately energize the heater and the timer during at least a portion of an automatic wrinkle release cycle, and the circuit is arranged to continuously energize the timer and to respond to load in order to periodically energize the heater during a time dry cycle.

BRIEF DESCRIPTION OF THE DRAWINGS

These and other features and advantages of the present invention will become more apparent from a detailed consideration of the invention when taken in conjunction with the drawings in which.

DETAILED DESCRIPTION

Figure 1:
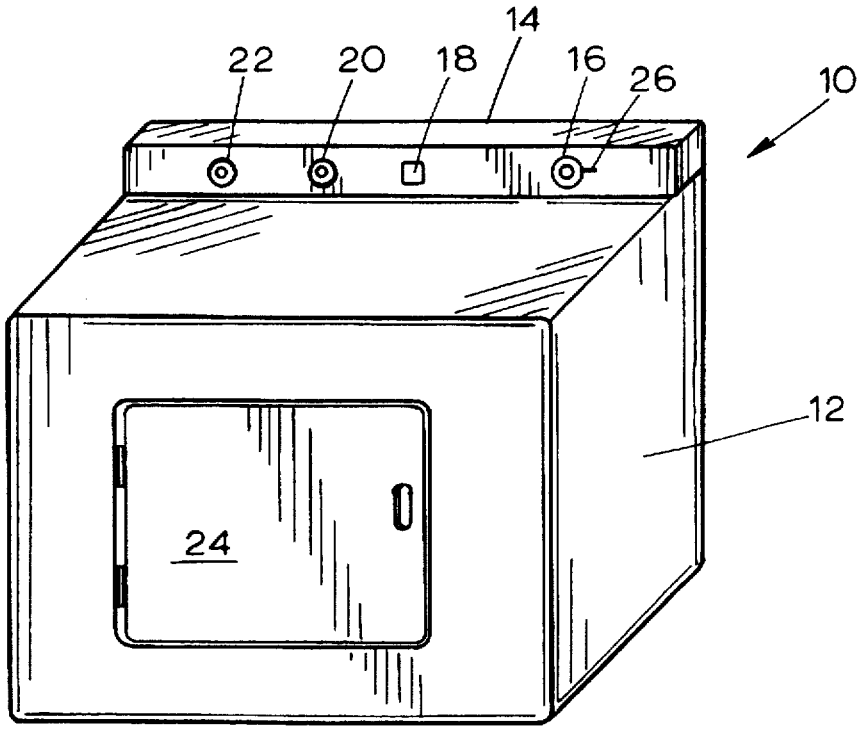
FIG. 1 is an isometric view of a dryer which incorporates the wrinkle out cycle according to the present invention.

A dryer 10, such as a clothes dryer, is shown in FIG. 1 and includes a cabinet 12 which houses a drying drum (not shown) into which articles are placed for drying, and which is rotated by a motor so as to tumble the articles to be dried. The cabinet 12 also houses air ducts through which air is drawn into the dryer 10, is passed over the articles to be dried, and is exhausted out of the dryer 10.

A console 14 is suitably attached to the cabinet 12 and supports various buttons, dials, and the like which control the operation of the dryer 10. For example, a timer dial/knob 16, which is supported by the console 14, may be manually operated in order to control the position of a cam stack which is also driven by a timer motor and which controls various operations of the dryer 10. The timer dial/knob 16 has an out position and a pushed in position with respect to the console 14. When the timer dial/knob 16 is pushed in, a start switch is closed in order to start operation of the dryer 10.

In addition to the timer dial/knob 16, a tumble switch 18 may be manually operated by a user if extended tumble of the articles in the dryer 10 is desired. During an extended tumble cycle, the drum within the cabinet 12 of the dryer 10 periodically rotates in order to tumble the articles contained therein. A loudness selector 20 may be included on the console 14 in order to select the loudness of an audible signal. This audible signal is controlled by the cam stack, which is mechanically attached to the timer dial/knob 16 and to the timer, and alerts the user that the dryer 10 has completed a cycle of operation. A fabric selector dial 22 is also included on the console 14 and controls a plurality of switches corresponding to types of fabrics that may be dried by the dryer 10. The cabinet 12 also includes a door 24 which may be opened to permit access to the drum of the dryer 10 into which articles may be inserted for drying.

Figure 2:
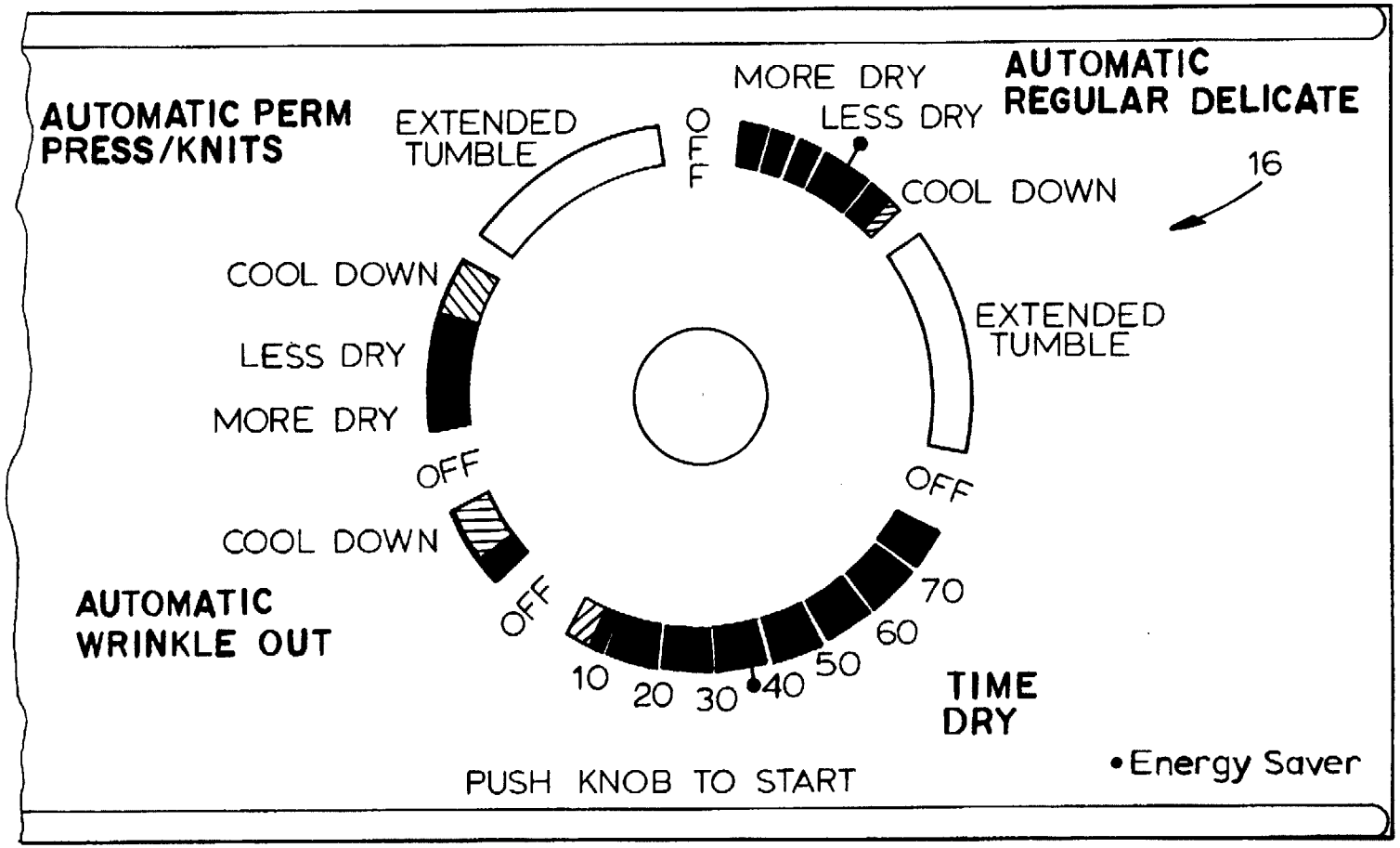
FIG. 2 shows a timer dial which is on the dryer of FIG. 1 and which includes a wrinkle out cycle.

The timer dial/knob 16 is shown in more detail in FIG. 2. As indicated by the timer dial/knob 16, a user of the dryer 10 may select from among a plurality of cycles by rotating the timer dial/knob 16 with respect to a mark 26 (FIG. 1) on the console 14. These cycles include an automatic regular/delicate cycle, a time dry cycle, an automatic wrinkle out cycle, and an automatic permanent press/knit cycle.

The automatic regular/delicate cycle, whose length of time is determined by both the dryer's timer and the dryer's temperature sensor and which may be used for regular and delicate fabrics, includes a drying portion and a cool down portion. As indicated in FIG. 2, the user may set the dryer's timer to a selected more dry or less dry position by rotating the timer dial/knob 16 so that the selected position is opposite the mark 26 on the console 14. The dryer's timer then advances down from this setting, and the advance of the dryer's timer is interrupted each time the dryer's heater is energized.

The time dry cycle, whose length of time is determined by the dryer's timer and not by the dryer's temperature sensor, includes a drying portion and a cool down portion. The user may set the dryer's timer to a selected number of minutes by rotating the timer dial/knob 16 so that the selected number of minutes is opposite the mark 26 on the console 14. The dryer's timer then advances down from this setting and is not interrupted when the dryer's heater is energized.

The automatic wrinkle out cycle, as will be discussed in more detail hereinafter, has a length of time that is determined by both the dryer's timer and the dryer's temperature sensor, and may be used to release wrinkles in fabrics. The automatic wrinkle out cycle includes a drying portion and a cool down portion. The user may rotate the timer dial/knob 16 to the drying portion of the wrinkle out cycle. The dryer's timer is preset to a minimum amount of time for the wrinkle out cycle. However, this preset minimum amount of time is extendable by the dryer's temperature sensor. That is, the dryer's timer advances down from this preset minimum amount of time but is interrupted each time the dryer's heater is energized.

The automatic permanent press/knit cycle, whose length of time is determined by both the dryer's timer and the dryer's temperature sensor and which may be used for permanent press and knit fabrics, includes a drying portion and a cool down portion. The user may set the dryer's timer to a more dry or less dry position by rotating the timer dial/knob 16 so that the selected position is opposite the mark 26 on the console 14. The dryer's timer then advances down from this setting and is interrupted each time the dryer's heater is energized.

Two extended tumble cycles, one following the automatic regular/delicate cycle and one following the automatic permanent press/knit cycle, may also be provided.

Figure 3:
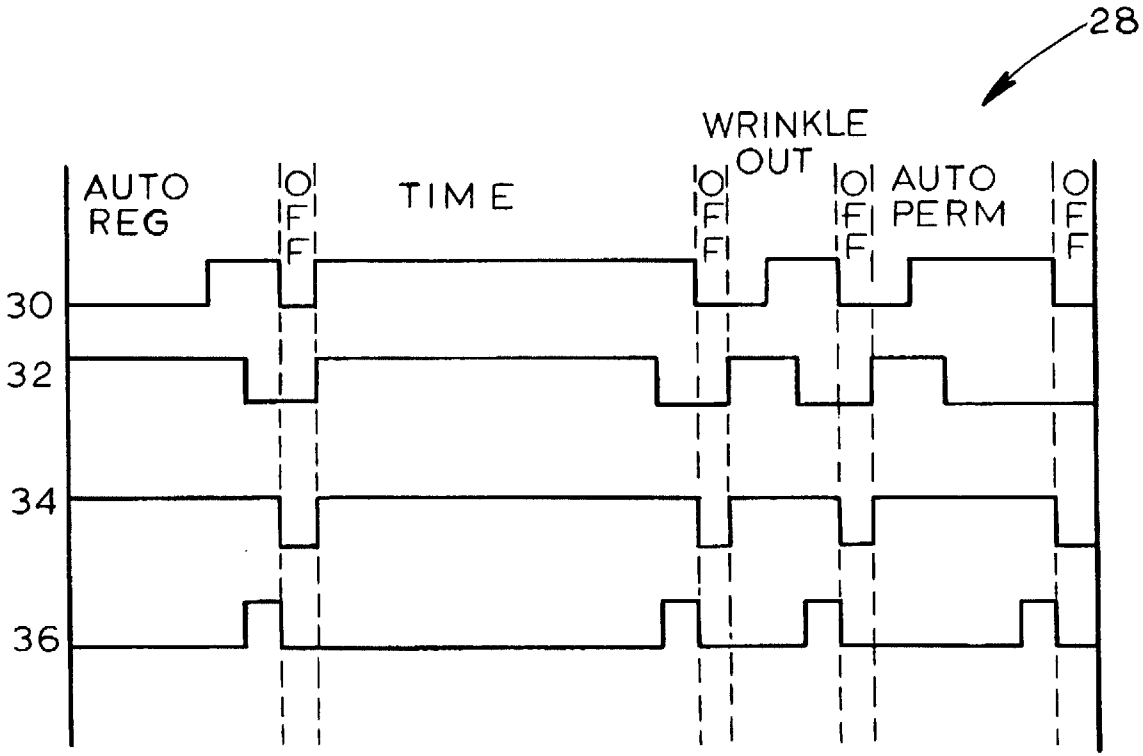
FIG. 3 illustrates cam profiles for a cam stack which is driven by a timer motor of the dryer of FIG. 1 and which provides a wrinkle out cycle; and, FIG. 4 is a wiring diagram of a dryer control for the dryer of FIG. 1.
Figure 4:
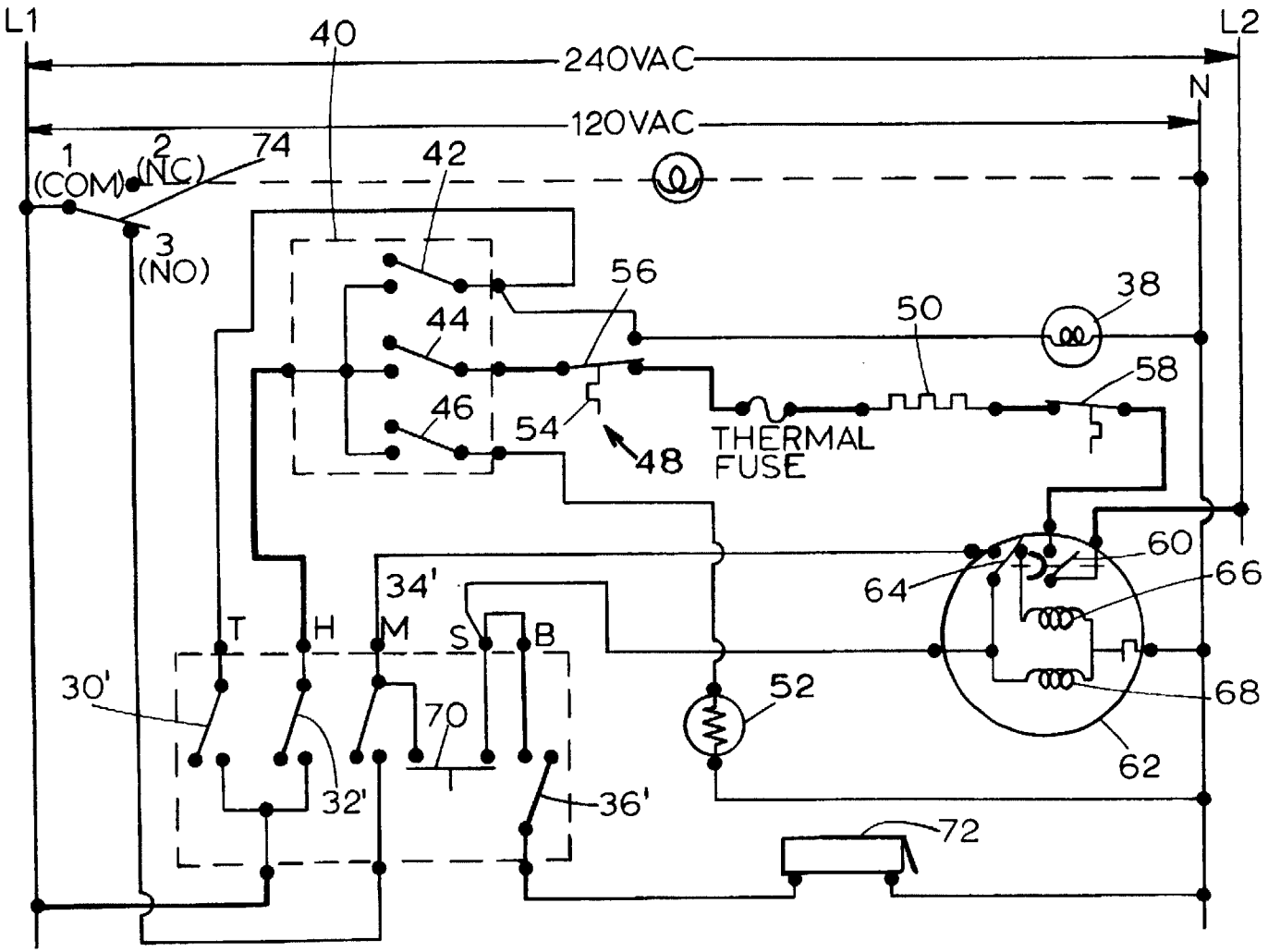

The timer dial/knob 16 is mechanically attached to a cam stack 28 (FIG. 3). The cam stack 28 is housed in the console 14 and is represented by corresponding first, second, third, and fourth cam profiles 30, 32, 34, and 36 which are shown in FIG. 3. The cams of the cam stack 28 corresponding to the first, second, third, and fourth cam profiles 30, 32, 34, and 36 operate corresponding first, second, third, and fourth timer switches 30', 32', 34', and 36' (FIG. 4). Accordingly, the first timer switch 30' is controlled by a cam represented by the first cam profile 30, the second timer switch 32' is controlled by a cam represented by the second cam profile 32, the third timer switch 34' is controlled by a cam represented by the third cam profile 34, and the fourth timer switch 36' is controlled by a cam represented by the fourth cam profile 36. When a cam profile is high, its corresponding switch is closed. Similarly, when a cam profile is low, its corresponding switch is opened. The timer dial/knob 16 and the cam stack 28 are both driven by a timer 38 (FIG. 4).

The first, second, third, and fourth timer switches 30', 32', 34', and 36' control the elements of the dryer 10 as discussed below in connection with FIG. 4. That is, the first timer switch 30' is essentially a timer control switch, the second timer switch 32' is essentially a heater control switch, the third timer switch 34' is essentially a motor control switch, and the fourth timer switch 36' is essentially a signalling control switch.

As shown in FIG. 4, the first timer switch 30' is connected in series with the timer 38. Accordingly, the timer 38 is directly controlled by the first timer switch 30'. The second timer switch 32' is connected to a fabric selector switch 40. The fabric selector switch 40 has first, second, and third fabric selector switches 42, 44, and 46 which are in series with the second timer switch 32'. The first fabric selector switch 42 controls the timer 38. The second fabric selector switch 44, in connection with a temperature sensor 48, controls a heater 50 and the timer 38. The third fabric selector switch 46 controls a thermostat heater 52. When the third fabric selector switch 46 is closed, the thermostat heater 52 is operated in order to add additional heat to a temperature sensing element 54 of the temperature sensor 48 which causes the temperature sensor 48 to be satisfied earlier than would otherwise be the case. Accordingly, the impact of the heater 50 may be reduced for delicate fabrics.

The fabric selector dial 22 determines which of the first, second, and third fabric selector switches 42, 44, and/or 46 are closed. For example, the fabric selector dial 22 may be moved to a fluff position in which the first fabric selector switch 42 is closed, the fabric selector dial 22 may be moved to a regular/permanent press position in which the second fabric selector switch 44 is closed, and the fabric selector dial 22 may be moved to a delicate position in which the second and third fabric selector switches 44 and 46 are closed. The fabric selector dial 22 is arranged with respect to the first, second, and third fabric selector switches 42, 44, and 46 so that at least one of the first, second, and third fabric selector switches 42, 44, and 46 is closed regardless of the position of the fabric selector dial 22. If the fabric selector dial 22 is set to the fluff position so that only the first fabric selector switch 42 is closed, the heater 50 cannot be operated. Therefore, if fabrics are to be fluffed, the drum of the dryer 10 is rotated, and air is supplied to the articles, but the heater 50 is not energized.

The temperature sensor 48 has the temperature sensing element 54 and a switch 56 controlled by the temperature sensing element 54. The switch 56 has a first position (between contacts one and two) and a second position (between contacts one and three). When the switch 56 is in its first position, the timer 38 is energized through the second timer switch 32', the second fabric selector switch 44, and the switch 56. When the switch 56 is in its second position, the heater 50 is energized through the second timer switch 32', the second fabric selector switch 44, the switch 56, a temperature limit switch 58, and a first motor switch 60 of a motor 62. The temperature limit switch 58 is provided in order to de-energize the heater 50 if the temperature inside the dryer 10 exceeds a predetermined limit.

The motor 62, which is essentially controlled by the third timer switch 34', turns the drum of the dryer 10 and also causes air to be circulated into the drum of the dryer 10 and exhausted out of the dryer 10. The motor 62 has a second motor switch 64, a start motor winding 66 which is energized to start operation of the motor 62, and a main motor winding 68 which is energized to run the motor 62. A push-to-start switch 70 is operated by the timer dial/knob 16 when the timer dial/knob 16 is pushed in by the user at the beginning of a dryer operation. A signalling device 72 is controlled by the fourth timer switch 36'. The signalling device 72 may include a repetitive make and break switch in order to periodically provide an audible signal at the end of a cycle. The loudness selector 20 is suitably connected to the signalling device 72 so as to control the loudness of the signal provided by the signalling device 72.

After the user loads the dryer 10 with articles to be dried by the automatic regular/delicate cycle, the user turns the fabric selector dial 22 to its regular/permanent press position which causes the second fabric selector switch 44 to close. The user also turns the timer dial/knob 16 until a desired time on the timer dial/knob 16 within the automatic regular/delicate cycle is opposite the mark 26. The user then pushes in the timer dial/knob 16. When the timer dial/knob 16 is rotated to the automatic regular/delicate cycle, the second timer switch 32' and the third timer switch 34' are closed as indicated by the second and third cam profiles 32 and 34 of FIG. 3. Also, when the user pushes in the timer dial/knob 16, the push-to-start switch 70 closes.

When the push-to-start-switch 70 closes, the start motor winding 66 is energized through a door switch 74, the third timer switch 34', the push-to-start switch 70, and the second motor switch 64. The door switch 74 closes against its normally open contact when the door 24 of the dryer 10 is closed by the user. Energization of the motor start winding 66 causes the first motor switch 60 to close and the second motor switch 64 to operate to its other position so that a main motor winding 68 of the motor 62 is now energized through the door switch 74 and the third timer switch 34'. The drum of the dryer 10 starts turning, and air is circulated through the rotating drum of the dryer 10.

Also, the heater 50 is now energized through the second timer switch 32', the second fabric selector switch 44, and the first motor switch 60 of the motor 62. The heater 50 heats the air circulated through the rotating drum of the dryer 10 by the motor 62. When the temperature of this air at the exhaust of the dryer 10 reaches a predetermined temperature, the temperature sensor 48 opens the circuit to the heater 50 and closes the circuit to the timer 38. The timer 38 turns the cam stack 28. When the temperature of the exhaust air falls sufficiently, the temperature sensor 48 closes the circuit to the heater 50 and opens the circuit to the timer 38. The timer 38 stops turning the cam stack 28. This process repeats until the cam stack 28 closes the first timer switch 30' as indicated by the cam profile 30 of FIG. 3.

Thereafter, the timer 38 continuously turns the cam stack 28 until the end of the automatic regular/delicate cycle. However, the temperature sensor 48 continues to control the heater 50 until the cam stack 28 opens the second timer switch 32' as indicated by the cam profile 32 of FIG. 3, after which the heater 50 is de-energized during a cool down period. Near the end of the cool down period, the cam stack 28 closes the fourth timer switch 36' as indicated by the cam profile 36 of FIG. 3 for a predetermined amount of time in order to energize the signalling device 72 to signal the end of the cycle.

If the user turns the timer dial/knob 16 until a desired time of the time dry cycle on the timer dial/knob 16 is opposite the mark 26 and pushes in the timer dial/knob 16, the first timer switch 30', the second timer switch 32', and the third timer switch 34' are closed as indicated by the first, second, and third cam profiles 30, 32, and 34 of FIG. 3, and the push-to-start switch 70 closes. When the push-to-start-switch 70 closes, the start motor winding 66 is energized through the door switch 74, the third timer switch 34', the push-to-start switch 70, and the second motor switch 64. Energization of the motor start winding 66 causes the first motor switch 60 to close and the second motor switch 64 to operate to its other position so that the main motor winding 68 of the motor 62 is now energized through the door switch 74 and the third timer switch 341. The drum of the dryer 10 starts turning, and air is circulated through the rotating drum of the dryer 10.

Because the first timer switch 30' is closed throughout the time dry cycle as indicated by the first cam profile 30 of FIG. 3, the timer 38 turns the cam stack 28 continuously throughout this cycle. Also, the heater 50 is cycled by the temperature sensor 48 in order to periodically heat the air circulated through the drum of the dryer 10. Near the end of the length of time selected by the user, the cam stack 28 opens the second timer switch 32' as indicated by the cam profile 32 of FIG. 3, after which the heater 50 is de-energized during a cool down period. Near the end of the cool down period, the cam stack 28 closes the fourth timer switch 36' as indicated by the cam profile 36 of FIG. 3 for a predetermined amount of time in order to energize the signalling device 72 to signal the end of the cycle.

If the user turns the timer dial/knob 16 to the wrinkle out cycle and pushes in the timer dial/knob 16, the second timer switch 32' and the third timer switch 34' are closed as indicated by the second and third cam profiles 32 and 34 of FIG. 3, and the push-to-start switch 70 closes. When the push-to-start-switch 70 closes, the start motor winding 66 is energized through the door switch 74, the third timer switch 34', the push-to-start switch 70, and the second motor switch 64. Energization of the motor start winding 66 causes the first motor switch 60 to close and the second motor switch 64 to operate to its other position so that a main motor winding 68 of the motor 62 is now energized through the door switch 74 and the third timer switch 34'. The drum of the dryer 10 starts turning, and air is circulated through the rotating drum of the dryer 10.

Also, the heater 50 is now energized through the first motor switch 60 of the motor 62, the second timer switch 32', and the second fabric selector switch 44. The heater 50 heats the air circulated through the rotating drum of the dryer 10 by the motor 62. When the temperature of this air at the exhaust of the dryer 10 reaches a predetermined temperature, the temperature sensor 48 opens the circuit to the heater 50 and closes the circuit to the timer 38. The timer 38 turns the cam stack 28. When the temperature of the exhaust air falls sufficiently, the temperature sensor 48 closes the circuit to the heater 50 and opens the circuit to the timer 38. The timer 38 stops turning the cam stack 28. This process repeats until the cam stack 28 closes the first timer switch 30' as indicated by the cam profile 30 of FIG. 3.

Thereafter, the timer 38 continuously turns the cam stack 28 until the end of the wrinkle out cycle. However, the temperature sensor 48 continues to control the heater 50 until the cam stack 28 opens the second timer switch 32' as indicated by the cam profile 32 of FIG. 3, after which the heater 50 is de-energized during a cool down period. Near the end of the cool down period, the cam stack 28 closes the fourth timer switch 36' as indicated by the cam profile 36 of FIG. 3 for a predetermined amount of time in order to energize the signalling device 72 to signal the end of the cycle.

If the user turns the timer dial/knob 16 to the automatic permanent press/knit cycle and pushes in the timer dial/knob 16, the second timer switch 321 and the third timer switch 34' are closed as indicated by the second and third cam profiles 32 and 34 of FIG. 3, and the push-to-start switch 70 closes. When the push-to-start-switch 70 closes, the start motor winding 66 is energized through the door switch 74, the third timer switch 34', the push-to-start switch 70, and the second motor switch 64. Energization of the motor start winding 66 causes the first motor switch 60 to close and the second motor switch 64 to operate to its other position so that a main motor winding 68 of the motor 62 is now energized through the door switch 74 and the third timer switch 34'. The drum of the dryer 10 starts turning, and air is circulated through the rotating drum of the dryer 10.

Also, the heater 50 is now energized through the first motor switch 60 of the motor 62, the second timer switch 32', and the second fabric selector switch 44. The heater 50 heats the air circulated through the rotating drum of the dryer 10 by the motor 62. When the temperature of this air at the exhaust of the dryer 10 reaches a predetermined temperature, the temperature sensor 48 opens the circuit to the heater 50 and closes the circuit to the timer 38. The timer 38 turns the cam stack 28. When the temperature of the exhaust air falls sufficiently, the temperature sensor 48 closes the circuit to the heater 50 and opens the circuit to the timer 38. The timer 38 stops turning the cam stack 28. This process repeats until the cam stack 28 closes the first timer switch 30' as indicated by the cam profile 30 of FIG. 3.

Thereafter, the timer 38 continuously turns the cam stack 28 until the end of the automatic permanent press/knit cycle. However, the temperature sensor 48 continues to control the heater 50 until the cam stack 28 opens the second timer switch 32' as indicated by the cam profile 32 of FIG. 3, after which the heater 50 is de-energized during a cool down period. Near the end of the cool down period, the cam stack 28 closes the fourth timer switch 36' as indicated by the cam profile 36 of FIG. 3 for a predetermined amount of time in order to energize the signalling device 72 to signal the end of the cycle.

Certain modifications of the present invention have been discussed above. Other modifications will occur to those practicing in the art of the present invention. For example, as described above, the mechanical timers and/or switches disclosed herein may instead be electronic timers and/or switches. The motor 62 may be configured other than shown in FIG. 4. Also, the cam profiles 30, 32, 34, and 36 shown in FIG. 3 are illustrative only and are not intended to exactly define the timing relationships between, and within, the various operations of the dryer 10.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A dryer having first and second automatic cycles comprising:

a heater;

a timer;

a temperature sensor; and, a circuit including the heater, the timer, and the temperature sensor, wherein the first automatic cycle is an automatic wrinkle release cycle, wherein the circuit is arranged to energize the heater during each of the first and second automatic cycles in response to the temperature sensor, to energize the timer during periods of each of the first and second automatic cycles when the heater is not energized, and to de-energize the timer during periods of each of the first and second automatic cycles when the heater is energized.

2. The dryer of claim 1 wherein the circuit is arranged during each of the first and second automatic cycles (i) to energize the heater until the temperature sensor is satisfied, (ii) to de-energize the timer while the heater is energized, (iii) to de-energize the heater when the temperature sensor is satisfied, and (iv) to energize the timer while the heater is de-energized.

3. The dryer of claim 1 wherein the circuit is arranged to control a duration of the automatic wrinkle release cycle in response to the temperature sensor and the timer.

4. The dryer of claim 1 wherein the temperature sensor comprises a first switch, wherein the timer comprises a timer motor and a second switch, and wherein the first and second switches are arranged to alternately connect the heater and the timer motor with power during one of the first and second automatic cycles.

5. The dryer of claim 1 wherein the temperature sensor comprises a first switch, wherein the timer comprises a timer motor and a second switch, and wherein the first and second switches are arranged to alternately connect the heater and the timer motor with power during each of the first and second automatic cycles.

6. The dryer of claim 5 wherein the timer comprises a third switch, and wherein the third switch is arranged to substantially continuously connect the timer motor with power during a non-automatic cycle.

7. The dryer of claim 1 wherein the timer comprises first and second cam profiles, wherein the first cam profile has first and second portions, wherein the second cam profile has first and second portions, wherein the first portions of the first and second cam profiles define the first automatic cycle, wherein the second portions of the first and second cam profiles define the second automatic cycle, wherein the first portions of the first and second cam profiles cause the heater and the timer to be alternately energized until the timer moves the cam profiles sufficiently, after which the timer is energized continuously until the end of the first portion of the first cam profile, and wherein the second portions of the first and second cam profiles cause the heater and the timer to be alternately energized until the timer moves the cam profiles sufficiently, after which the timer is energized continuously until the end of the second portion of the first cam profile.

8. The dryer of claim 7 wherein the first cam profile has a third portion, wherein the second cam profile has a third portion, wherein the third portions of the first and second cam profiles define a non-automatic cycle, wherein the third portion of the first cam profile causes the timer to be energized continuously until the timer moves the cam profiles to an end of the third portion of the first cam profile, after which the timer is de-energized, and wherein the third portion of the second cam profile causes the heater to be energized through the temperature sensor until near the end of the third portion of the first cam profile, after which the heater is de-energized continuously until the timer moves the cam profiles to the end of the third portion of the first cam profile.

9. The dryer of claim 1 further comprising a third automatic cycle, wherein the circuit is arranged to energize the heater during the third automatic cycle in response to the temperature sensor, to energize the timer during periods of the third automatic cycle when the heater is not energized, and to de-energize the timer during periods of the third automatic cycle when the heater is energized.

10. The dryer of claim 1 wherein the timer has first and second timer portions for each of the first and second automatic cycles, wherein the heater and the timer are alternately energized in response to the temperature sensor during the first timer portions of each of the first and second automatic cycles, wherein the timer but not the heater is energized during the second timer portions of each of the first and second automatic cycles, and wherein the first portion of the first automatic cycle is shorter than the first portion of the second automatic cycle.

11. A dryer comprising:

a heater;

a timer;

a temperature sensor; and, a circuit including the heater, the timer, and the temperature sensor, wherein the circuit is responsive to the temperature sensor to alternately energize the heater and the timer during first portions of first and second cycles and to continuously energize the timer during second portions of the first and second cycles in such a way that the first cycle is an automatic wrinkle release cycle.

12. The dryer of claim 11 wherein the first portion of the first cycle is shorter that the first portion of the second cycle.

13. The dryer of claim 12 wherein the temperature sensor includes a first switch, wherein the timer includes a timer motor and a second switch, and wherein the first and second switches are arranged substantially in series to alternately connect the heater and the timer motor with power during the first portions of the first and second cycles.

14. The dryer of claim 13 wherein the timer comprises a third switch, and wherein the third switch is arranged to continuously connect the timer motor with power during the second portions of the first and second cycles.

15. The dryer of claim 14 wherein the third switch is arranged to continuously connect the timer motor with power during a third cycle.

16. The dryer of claim 15 wherein the timer comprises first and second cam profiles, wherein the first cam profile controls the second switch, and wherein the second cam profile controls the third switch.

17. The dryer of claim 16 wherein the first cam profile closes the second switch during the first portions of the first and second cycles, wherein the second cam profile opens the third switch during the first portions of the first and second cycles, wherein the second cam profile closes the third switch during the second portions of the first and second cycles, and wherein the second cam profile closes the third switch during the third cycle.

18. The dryer of claim 17 wherein the first and second switches are arranged to alternately connect the heater and the timer motor with power during a fourth cycle, wherein the first cam profile closes the second switch during a first portion of the fourth cycle, wherein the second cam profile opens the third switch during the first portion of the fourth cycle, and wherein the second cam profile closes the third switch during a second portion of the fourth cycle.

19. The dryer of claim 18 wherein the timer includes fourth and fifth switches, wherein the fourth switch is controlled by a third cam profile to energize a dryer motor during the first, second, third, and fourth cycles, and wherein the fifth switch is controlled by a fourth cam profile to energize a signalling device near an end of the first, second, third, and fourth cycles.

20. The dryer of claim 11 wherein the circuit is responsive to the temperature sensor to alternately energize the heater and the timer during a first portion of a third cycle and to continuously energize the timer during a second portion of the third cycle.

21. A dryer having a circuit including a heater and a timer, wherein the circuit is arranged to respond to load in order to alternately energize the heater and the timer during at least a portion of an automatic permanent press cycle, wherein the circuit is arranged to respond to load in order to alternately energize the heater and the timer during at least a portion of an automatic regular cycle, wherein the circuit is arranged to respond to load in order to alternately energize the heater and the timer during at least a portion of an automatic wrinkle release cycle, and wherein the circuit is arranged to continuously energize the timer and to respond to load in order to periodically energize the heater during a time dry cycle.

22. The dryer of claim 21 wherein the timer includes a timer motor and first and second switches, wherein the first and second switches are arranged to alternately energize the heater and the timer motor power during the corresponding portions of the automatic permanent press cycle, the automatic regular cycle, and the automatic wrinkle release cycle, and wherein the first switch is arranged to continuously connect the timer motor with power during the time dry cycle.

23. The dryer of claim 22 wherein the timer includes third and fourth switches, wherein the third switch is arranged to energize a dryer tumble motor during the automatic permanent press cycle, the automatic regular cycle, the automatic wrinkle release cycle, and the time dry cycle, and wherein the fourth switch is arranged to energize a signalling device near an end of the automatic permanent press cycle, the automatic regular cycle, the automatic wrinkle release cycle, and the time dry cycle.

24. The dryer of claim 23 wherein the first, second, third, and fourth switches are controlled by corresponding cam profiles.

* * * * *